United States Patent [19]

Meyer et al.

[11] 4,200,081

[45] Apr. 29, 1980

[54] VALVE SELECTOR

[75] Inventors: Lawrence L. Meyer, Northville; Robert S. Mueller, Birmingham; Michael M. Walsh, Northville, all of Mich.

[73] Assignee: Eaton Corporation, Cleveland, Ohio

[21] Appl. No.: 641,004

[22] Filed: Dec. 15, 1975

[51] Int. Cl.[2] ..... F02D 13/06

[52] U.S. Cl. ..... 123/198 F; 123/90.16; 123/90.32; 123/90.39

[58] Field of Search ..... 123/198 F, 90.15, 90.16, 123/90.27, 90.32, 90.39, 90.47

[56] References Cited

U.S. PATENT DOCUMENTS

| | | | |
|---|---|---|---|
| 2,023,048 | 12/1935 | Gentile | 123/90.16 |
| 2,745,391 | 5/1956 | Winkler | 123/198 F |
| 2,851,023 | 9/1958 | Dorkan | 123/90.16 |
| 3,179,094 | 4/1965 | Ribeton | 123/90.39 |
| 3,641,988 | 2/1972 | Torazza et al. | 123/90.27 |
| 4,050,435 | 9/1977 | Fuller, Jr. et al. | 123/198 F |
| 4,064,861 | 12/1977 | Schulz | 123/198 F |

*Primary Examiner*—Ira S. Lazarus

*Attorney, Agent, or Firm*—R. J. McCloskey; D. Wood; P. Rulon

[57] ABSTRACT

A device for disabling a poppet valve in an internal combustion engine. The engine includes a valve actuating drive train having an overhead camshaft, a hydraulic lash adjuster, and a rocker arm which pivots at one end about the lash adjuster. The disabling device is secured to the valve stem and is drivingly interposed between the valve and the other end of the rocker arm. The disabling device includes a cap and drum or first drive means moveable with the rocker arm and relative to the valve stem, first and second springs concentric to the valve stem and respectively apply a biasing force to the first and second drive means and a rotatable latch. The latch is moveable between a valve enabling position and a valve disabling position. The valve is enabled for normal opening and closing when the latch is in the valve enabling position; in this position the latch prevents relative movement between the first and second drive means and both springs bias the valve closed. The valve is disabled when the latch is in the valve disabling position, in this position the latch allows relative movement between the first and second drive means and the first spring biases the first drive means into contact with the rocker arm and the second spring biases the valve closed.

19 Claims, 4 Drawing Figures

VALVE SELECTOR

CROSS-REFERENCES

This application relates to copending applications Ser. No. 578,295, filed May 16, 1975 and assigned to the assignee of this application.

BACKGROUND OF THE INVENTION

1. Field of the Invention

The invention relates to a device for enabling and disabling a valve actuated by a rocker arm and more specifically to deactivating selected cylinders of an internal combustion engine by disabling the valves associated with the selected cylinders.

2. Description of the Prior Art

The concept of deactivating selected cylinders of an engine by disabling the valves associated with the selected cylinders is old. When this concept is applied to an Otto Cycle Engine, pumping or throttling losses are reduced, thereby improving engine efficiency during part throttle operation. Devices proposed in the prior art to carry out the concept have had some disadvantages, e.g. they were either expensive, unreliable, required extensive engine modifications, could not be switched on or off during engine operation, or caused clashing of components in the valve drive train due to the devices either physically separating valve train components or reducing forces tending to keep connecting components in driving contact.

SUMMARY OF THE INVENTION

An object of this invention is to provide a simple, low cost and reliable valve disabling device.

Another object of this invention is to provide the valve disabling device which is particularly suited for use in an engine of the overhead camshaft type.

According to a feature of this invention, the disabler device includes a drive means adapted to be drivingly interposed between one end of a rocker arm and a valve, a moveable latch operative in one position to enable the valve for normal opening and closing by preventing relative movement between the drive means and the valve and operative in another position to disable the valve by allowing relative movement between the drive means and the valve, a first spring biasing the drive means towards the rocker arm independent of the position of the latch, a second spring biasing the valve towards the closed position, and means operative to apply the biasing force of the first spring to the valve in the valve closing direction when the latch is in the valve enabling position.

According to another feature of this invention, the disabling device includes a drive means adapted to be drivingly interposed between one end of a rocker arm and a valve, first and second springs respectively biasing the drive means towards the rocker arm and the valve towards the closed position, a moveable latch operative in one position to enable the valve for normal opening and closing by preventing relative movement between the drive means and the valve and operative in another position to disable the valve by allowing relative movement between the drive means and the valve, and stop means for limiting movement of the drive means relative to the valve and in the direction of said rocker arm.

BRIEF DESCRIPTION OF THE DRAWINGS

The preferred embodiment of the invention is shown in the accompanying drawings in which.

DETAILED DESCRIPTION OF THE DRAWINGS

Figure 1:
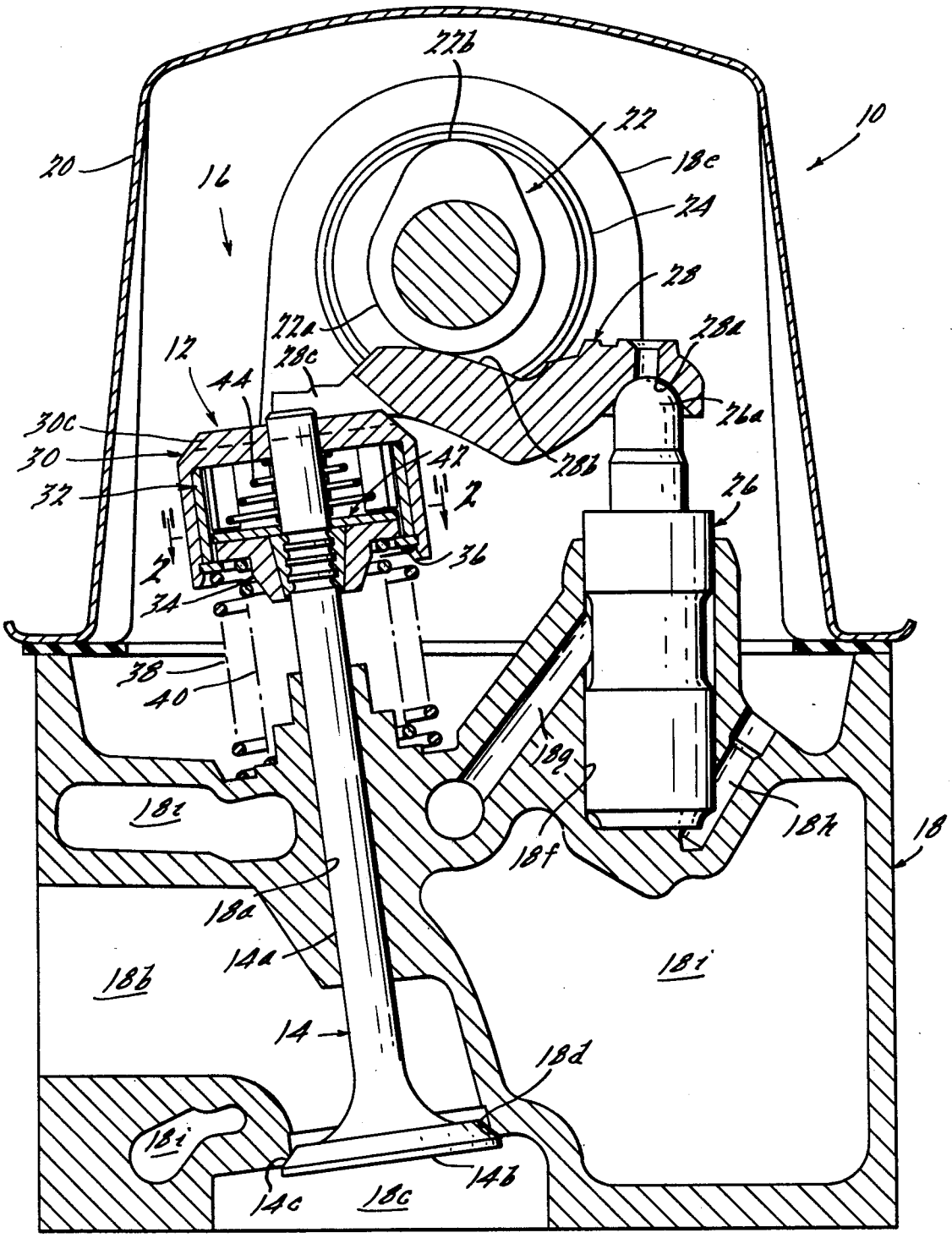
FIG. 1 is a sectional view of an internal combustion engine cylinder head embodying a valve disabling device.

Referring now to FIG. 1, therein is shown in cross-section an engine cylinder head assembly 10 of the overhead cam type. Cylinder head assembly 10 is adapted to embody a valve disabler device 12 of the present invention. The head assembly shown forms no part of the present invention and merely provides one example of the type of environment in which valve disabler device 12 may be embodied.

Head assembly 10 includes a valve 14, a valve drive train 16 for operating the valve, a cast head structure 18, and a sheet metal valve cover 20.

Valve 14 is of the poppet type having a stem portion **14*a* slideably disposed in a guide 18*a* defined by head structure 18 and a valve head portion 14*b*. Valve head portion 14*b* blocks the flow of gases between a passage 18*b* and a recess 18*c* when a tapered face 14*c* on the valve head rests on a valve seat 18*d* defined by the head structure. Recess 18*c*** opens into an unshown combustion chamber.

Valve drive train 16 is substantially conventional and includes a camshaft 22 journaled in a bearing 24 which is supported by an arched portion **18*e* defined by the head structure, a hydraulic lash adjuster 26 supported in a bore 18*f* defined by the head structure, and a rocker arm 28. Lash adjuster 26 includes a piston having a hemispherical end 26*a* seated in a mating socket 28*a* at one end of the rocker arm. Cam shaft 22 includes a cam having a dwell portion 22*a* and a lift portion 22*b* which portions are in constant sliding contact with a midportion 28*b*** of the rocker arm.

Head structure 18 includes in addition to the above a passage **18*g* for supplying pressurized oil to the lash adjuster, a passage 18*h* for draining bore 18*f* and assisting in the installation of the adjuster, and three irregular shaped coolant passages 18*i***.

Disabler device 12 includes a cap 30, a locking drum 32, a retainer 34, a snap ring 36, a spring 38 reacting between the head structure and snap ring 36, a spring 40 in parallel with spring 38 and reacting between the head structure and retainer 34, a rotatable latch 42, and a cone shaped helical spring 44 for biasing latch 42 against retainer 34. Cap 30 and locking drum 32 form a first drive means. Retainer 34 forms a second drive means. Latch 42 is rotatable between a valve enabling position preventing relative movement between the first and second drive means and valve disabling position allowing relative movement between the first and second drive means.

Figure 2:
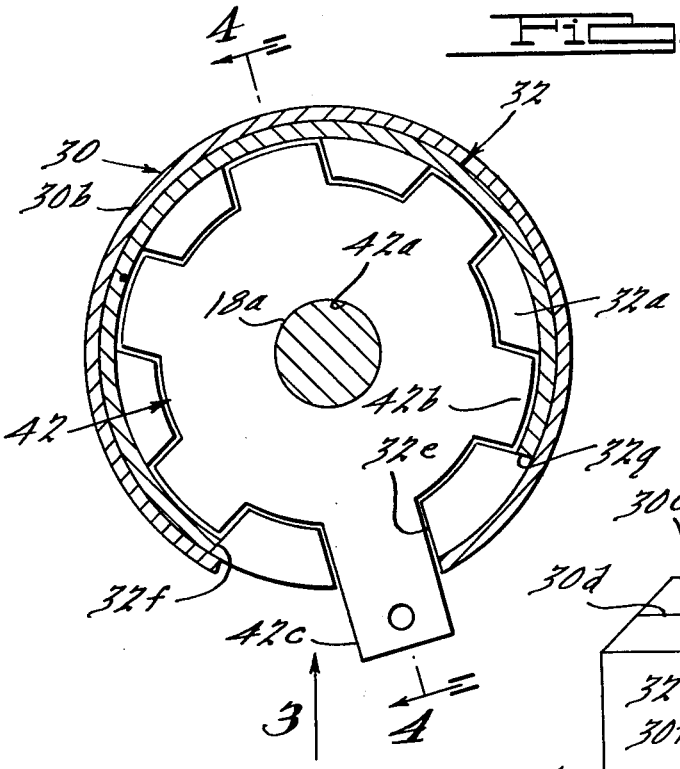
FIG. 2 is a sectional view of the disabler device looking along the line 2—2 of FIG. 1.
Figure 3:
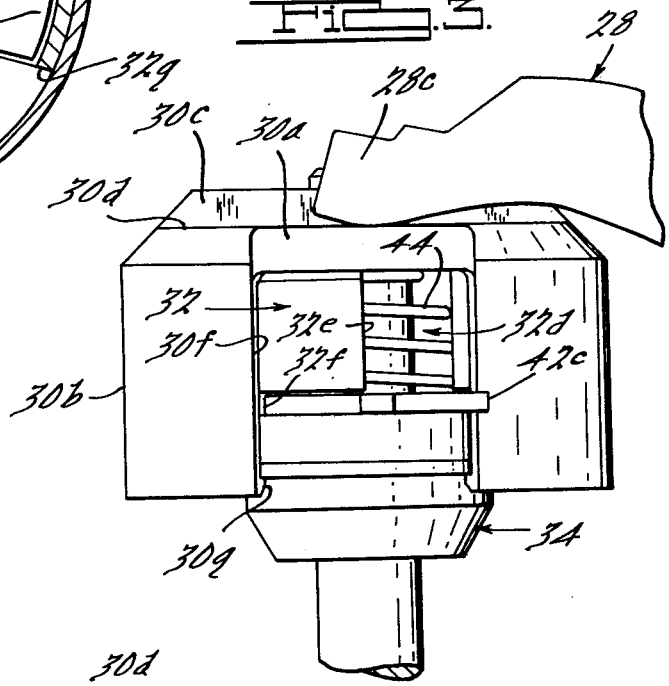
FIG. 3 is a view of the disabler device looking in the direction of arrow 3 of FIG. 2.
Figure 4:
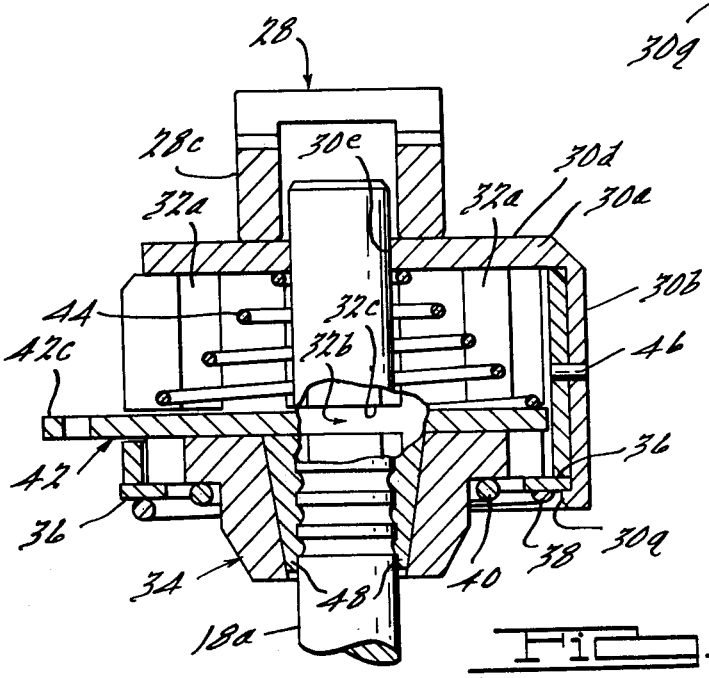
FIG. 4 is a sectional view of the disabler device looking along the line 4—4 of FIG. 2.

A more detailed description of disabler 12 is given with reference to FIGS. 2, 3, and 4. Cap 30 includes a top portion **30*a* and a cylindrical side wall portion 30*b*. Top portion 30*a* includes a rib 30*c* across the diameter of its upper surface 30***d* and an aperture 30*e* having a diameter equal to the width of the rib. Rib 30*c* receives a bifurcated end 28*c* of the rocker arm, which rib and bifurcated end coact to retain the cap against rotation. Aperture 30*e* slideably receives the upper end of valve stem 18*a* and concentrically locates the cap with respect to the valve stem axis. Cylindrical wall 30*b* includes an opening or window 30*f* and a radially inwardly extending lip 30*g*.

Locking drum 32 fits snugly in cap 30 and includes a plurality of teeth or internal splines 32*a* extending substantially the length of the drum wall and parallel to its central axis, an annular groove 32*b* defined by an annular notch 32*c* in each spline 32*a*, and an inverted T shaped opening 32*d*. Opening 32*d* includes a vertical opening portion 32*e* having an arc width one half the number of degrees of the width of opening 30*f* in the cap and horizontal slots 32*f* and 32*g* which each have a width equal to the width of vertical opening 32*e*. A pin 46 retains the drum against rotation in the cap.

Retainer 34 functions as a valve spring retainer, as do conventional valve spring retainers, and as a support member of the valve disabler device. The retainer is secured to the valve stem by a pair of tapered keys 48 in a conventional manner. Retainer 34 includes a plurality of unshown teeth which slideably mate with splines 32*a*.

Snap ring 36 cooperates with lip 30*g* to hold the disabler device together and transmits the biasing force of spring 38 to the retainer and valve when the valve is open and when the cam dwell portion is in contact with the rocker arm.

The biasing force of spring 38 is great enough to prevent clashing of valve drive train components by maintaining cap 30 in contact with end 28*c* of the rocker arm and to prevent ballooning or over extending of the hydraulic lash adjuster. The biasing force of spring 40 is great enough to prevent opening of the valve due to suction pressures in recess 18*c*.

Rotatable latch 42 is disk shaped and includes a central aperture 42*a*, a plurality of teeth 42*b* disposed in annular groove 32*b* of the locking drum, and an actuating arm 42*c* provided by an extension of one of the teeth 42*b*. Aperture 42*a* is rotatably received by valve stem 18*a* which retains the latch against radial movement. Teeth 42*b* are substantially identical to the unshown teeth of retainer 34. Latch 42 is moveable from a valve disabling position, which disabling position is shown in FIG. 2, to a valve enabling position by rotating actuating arm 42*c* clockwise as viewed in FIG. 2. When the latch is in the valve disabling position splines 32*a* slide over the unshown teeth of retainer 34 and over teeth 42*b* in response to pivotal movement of the rocker arm, whereby spring 38 flexes in response to movement of the cap and locking drum. Spring 40 maintains valve 18 closed when the latch is in the valve disabling position. When the latch is in the valve enabling position teeth 42*b* are restrained in notches 32*c*, thereby preventing movement of the cap and locking drum relative to the latch and retainer and causing the valve to move in response to pivotal movement of the rocker arm.

In the disclosed embodiment, the position of locking drum 32 in cap 30 is such that vertical opening 32*e* and horizontal opening 32*f* align with opening 30*f* in the cap, and horizontal opening 32*g* is unused and covered by cylindrical side wall 30*b*. When the openings are so aligned, valve 18 is enabled by clockwise rotation of latch 42 and disabled by counterclockwise rotation of the latch. The direction of latch rotation for valve enablement and disablement may be reversed by positioning the locking drum in the cap so that horziontal opening 32*f* is covered by the cylindrical side wall thereby aligning vertical opening 32*e* and horizontal opening 32*g* with opening 30*f*.

Any of several well known types of actuators may be used to provide a force for rotating latch 42 from the valve enabling position to the valve disabling position. The force is preferably great enough to insure rapid rotation of the latch, but also low enough to be ineffective when the valve is open, i.e., the force is ineffective to overcome the friction between teeth 42*b* and notches 36*c* when the cam is moving the disabling device and the valve as a unit.

A preferred embodiment of the invention has been disclosed for illustrative pruposes. Many variations and modifications of the preferred embodiment are believed to be within the spirit of the invention. The following claims are intended to cover the inventive portions of the preferred embodiment and variations and modifications believed to be within the spirit of the invention.

What is claimed is:

1. An improved valve disabling device in a machine of the type having a valve which is normally opened and closed in response to pivotal movement of a rocker arm, said improved disabling device comprising:

drive means drivingly interposed between one end of said rocker arm and said valve and in contact with said one end of said rocker arm;

latch means moveable from a valve enabling position preventing relative movement between said drive means and said valve for enabling said valve for normal opening and closing and moveable to a valve disabling position allowing relative movement between said drive means and said valve for disabling said valve;

first resilient means for biasing said drive means towards said one end of said rocker arm independent of the position of said latch means;

second resilient means for biasing said valve toward the closed position; and means operative to apply at least a portion of the biasing force of said first resilient means to said valve in the closing direction when said latch is in said valve enabling position.

2. The improved valve disabling device of claim 1, further including:

stop means for limiting movement of said drive means in the biased direction.

3. An improved valve disabling device in a machine of the type having a valve which is normally opened and closed in response to pivotal movement of a rocker arm, said improved disabling device comprising:

drive means drivingly interposed between one end of said rocker arm and said valve and in contact with said one end of said rocker arm;

first resilient means for biasing said drive means towards said one end of said rocker arm;

second resilient means for biasing said valve toward the closed position;

latch means moveable from a valve enabling position preventing relative movement between said drive means and said valve for enabling said valve for normal opening and closing and moveable to a valve disabling position allowing relative movement between said drive means and said valve for disabling said valve; and stop means for limiting movement of said drive means in the biased direction.

4. A valve disabling device in a machine of the type having a stemmed poppet valve which is normally opened and closed in response to pivotal movement of a rocker arm, said disabling device comprising:

means drivingly interposed between one end of said rocker arm and said valve stem, said means including:

first drive means in driving contact with said one end of said rocker arm and disposed for sliding movement along the axis of the valve stem and operative to move along said axis in response to pivotal movement of said rocker arm, and a second drive means fixed to said valve;

latch means moveable to a valve enabling position preventing relative movement between said first and second drive means, thereby enabling said valve for normal opening and closing in response to pivotal movement of said rocker arm, and moveable to a valve disabling position allowing relative movement between said first and second drive means, thereby disabling said valve;

first resilient means concentric to said stem for biasing said first drive means along said axis and toward said one end of said rocker arm independent of the position of said latch means; and second resilient means concentric to said stem and applying a force against said second drive means acting in the same direction as the force of said first resilient means and operative to bias said valve closed.

5. The disabling device of claim 4, further including:

stop means for limiting movement of said first drive means toward said one end of said rocker arm and operative to transmit the biasing force of said first biasing means to said second drive means when said valve is open.

6. The disabling device of claim 5, wherein said stop means further transmits the biasing force of said first biasing means to said second drive means independent of the position of said latch means when said valve is closed and said first drive means is not being moved relative to said second drive means.

7. The disabling device of claim 4, wherein:

said first drive means includes a cylindrical portion concentric to said valve stem axis and having a set of internal splines extending parallel to said axis, and each spline having a notch therein defining an annular groove;

said second drive means extends radially outward from said stem within said cylindrical portion and includes a set of teeth on its periphery which slideably mate with said splines; and said latch means includes a disc shaped portion rotatably disposed about said stem and within said cylindrical portion, said disc portion having a set of teeth on its periphery which slideably mate with said internal splines and align with the teeth of said second drive means when said latch is in said valve disabling position and which register with said notches when said latch is rotated to said valve enabling position.

8. An improved valve disabling device in an internal combustion engine of the type having a valve drive train including a valve, a cam on a camshaft and a rocker arm which normally opens and closes the valve in response to the cam causing pivotal movement of the rocker arm, said improved device comprising:

drive means interposed between said one end of said rocker arm and said valve and in driving contact with said one end of said rocker arm;

latch means moveable from a valve enabling position preventing relative movement between said drive means and said valve for enabling said valve for normal opening and closing and moveable to a valve disabling position allowing relative movement between said drive means and said valve for disabling said valve;

first resilient means for biasing said drive means towards said one end of said rocker arm independent of the position of said latch means;

second resilient means for biasing said valve toward the closed position; and means operative to apply the biasing force of said first resilient means to said valve in the closing direction when said latch is in said valve enabling position, whereby the combined biasing force of said first and second resilient means is operative to bias said valve toward the closed position when said valve is enabled for normal opening and closing.

9. The improved valve disabling device of claim 8, further including:

stop means for limiting movement of said drive means in the biased direction, whereby the biasing force of said first resilient means is isolated from said drive train when said cam is not pivoting said rocker arm.

10. An improved valve disabling device in an internal combustion engine of the type having a valve drive train including a valve, a cam on a camshaft and a rocker arm which normally opens and closes the valve in response to the cam causing pivotal movement of the rocker arm, said improved devices comprising:

drive means interposed between said one end of said rocker arm and said valve and in driving contact with said one end of said rocker arm;

fist resilient means for biasing said drive means towards said one end of said rocker arm;

second resilient means for biasing said valve toward the closed position;

latch means moveable from a valve enabling position preventing relative movement between said drive means and said valve for enabling said valve for normal opening and closing and moveable to a valve disabling position allowing relative movement between said drive means and said valve for disabling said valve; and stop means for limiting movement of said drive means in the biased direction, whereby the biasing force of said first resilient means is isolated from said drive train when said cam is not pivoting said rocker arm.

11. The engine of claim 10, further including hydraulic means for preventing lash in said valve drive train and wherein said first resilient means of said disabling device provides a force sufficient to prevent ballooning of said hydraulic means when said latch is in said valve disabling position and said stop means prevents collapsing of said hydraulic means when said cam is not pivoting said rocker arm.

12. An improved valve disabling device in an internal combustion engine of the type having a valve drive train including a stemmed poppet valve, a cam on a camshaft, and a rocker arm which normally opens and closes the valve in response to the cam causing pivotal movement of the rocker arm, said improved device comprising:

first drive means in driving contact with said one end of said rocker arm and disposed for sliding movement along the axis of the valve stem and operative to move along said axis in response to pivotal movement of said rocker arm;

second drive means fixed to said valve stem;

latch means moveable to a valve enabling position preventing relative movement of said first and second drive means, thereby enabling said valve for normal opening and closing in response to pivotal movement of said rocker arm, and moveable to a valve disabling position allowing relative movement between said first and second drive means thereby disabling said valve;

first resilient means concentric to said stem for biasing said first drive means along said axis and toward said one end of said rocker arm independent of the position of said latch means; and second resilient means concentric to said stem and applying a force against said second drive means acting in the same direction as the force of said first resilient means and operative to bias said valve closed.

13. The disabling device of claim 12, further including:

stop means for limiting movement of said first drive means toward said one end of said rocker arm and operative to transmit the biasing force of said first biasing means to said second drive means when said valve is open.

14. The disabling device of claim 13, wherein said stop means further transmits the biasing force of said first biasing means to said second biasing means when said valve is closed and said first drive means is not being moved relative to said second drive means.

15. The disabling device of claim 12 wherein:

said first drive means includes a cylindrical portion concentric to said valve stem axis and having a set of internal splines extending parallel to said axis, and each spline having a notch therein defining an annular groove;

said second drive means extends radially outward from said stem within said cylindrical portion and including a set of teeth on its periphery which slideably mate with said splines; and said latch means includes a disc shaped portion rotatably disposed about said stem and within said cylindrical portion, said disc portion having a set of teeth on its periphery which slideably mate with said internal splines and align with the teeth of said second drive means when said latch is in said valve disabling position and which register with said notches when said latch is rotated to said valve enabling position.

16. The disabling device of claim 15, wherein said disk shaped portion is supported against sliding movement relative to the axis of said valve stem by said second drive means.

17. The disabling device of claim 16, further including:

resilient means biasing said disk shaped portion against said second drive means.

18. The disabling device of claim 15, further including:

stop means on said first drive means which contact said second drive means for limiting movement of said drive means in the biased direction, whereby the biasing force of said first resilient means is isolated from said drive train when said cam is not pivoting said rocker arm.

19. The engine of claim 18, further including hydraulic means for preventing lash in said valve drive train and wherein said first resilient means of said disabling device provides a force sufficient to prevent ballooning of said hydraulic means when said latch is in said valve disabling position and said stop means prevents collapsing of said hydraulic means when said cam is not pivoting said rocker arm.

* * * * *